United States Patent [19]

Nourney

[11] 4,228,715

[45] Oct. 21, 1980

[54] STRAIN-GAUGE SOUND PICKUP FOR STRING INSTRUMENT

[76] Inventor: Carl-Ernst Nourney, Am Wagenrast 6, D-4000 Düsseldorf 12, Fed. Rep. of Germany

[21] Appl. No.: 935,916

[22] Filed: Aug. 23, 1978

[30] Foreign Application Priority Data

Aug. 25, 1977 [DE] Fed. Rep. of Germany ..... 2738256

[51] Int. Cl.[3] ..... G10H 3/18

[52] U.S. Cl. ..... 84/1.16; 84/DIG. 27

[58] Field of Search ..... 84/1.04, 1.06, 1.14–1.16, 84/DIG. 1, DIG. 27

[56] References Cited

U.S. PATENT DOCUMENTS

| | | | |
|---|---|---|---|
| 3,049,958 | 8/1962 | Benioff | 84/1.16 |
| 3,530,228 | 9/1970 | Scherer | 84/1.16 |
| 3,684,814 | 8/1972 | Neustadt | 84/1.04 |
| 3,712,951 | 1/1973 | Rickard | 84/1.14 |
| 3,733,953 | 5/1973 | Ferber | 84/1.16 |

FOREIGN PATENT DOCUMENTS

| | | | |
|---|---|---|---|
| 931689 | 8/1955 | Fed. Rep. of Germany | 84/1.16 |

*Primary Examiner*—S. J. Witkowski
*Attorney, Agent, or Firm*—Karl F. Ross

[57] ABSTRACT

A musical instrument such as a guitar or piano has a plurality of elongated strings maintained under longitudinal tension and bearing through a bridge on a sounding element. This sounding element is subdivided by a plurality of slots into a plurality of sections each bearing against a respective one or more strings and each carrying on its outer faces at least one strain gauge. The strain gauge is extends between the respective string and the sounding element, with its direction of sensitivity perpendicular to both. Such a strain gauge is therefore used as an electronic tone pickup for the string instrument.

8 Claims, 7 Drawing Figures

STRAIN-GAUGE SOUND PICKUP FOR STRING INSTRUMENT

FIELD OF THE INVENTION

The present invention relates to a sound pickup for a string instrument. More particularly this invention concerns such a pickup which transduces the vibrations directly from the instrument.

BACKGROUND OF THE INVENTION

A string instrument, whether of the neck type (guitar, violin, cello, bass fiddle) or of the piano type (pianoforte, harpsichord), has a plurality of strings which are maintained taut so that when plucked, bowed, or hammered they produce a predetermined tone. These strings bear via a bridge on a resonance element, which may be the body of a guitar or a violin or the resonance board of a piano, which resonates and radiates the tone produced by the string. This bridge is normally provided adjacent the anchored end of the string, that is the fixed end of the string as contrasted to the opposite end of the string that is normally connected to a tuning pin or peg.

In order to electronically record or amplify such sounds it is best practice to provide a tone pickup directly on the instrument, rather than simply to play the instrument adjacent a microphone which would also pick up many spurious sounds. To this end it is known to mount a piezoelectric microphone directly on the sounding board of the instrument, often adjacent the bridge thereof. Such a pickup is in turn connected to the appropriate amplifying and/or recording equipment.

The difficulty with this type of system, is that the tone pickup is still relatively sensitive to external sounds, and in particular it is sensitive to acoustic feedback. This last-mentioned sensitivity is particularly prevalent when the sounds being transduced by the pickup are being amplified and played on the spot, as for instance in a concert. The amplified sounds are detected by the pickup in the manner of a positive feedback. What is more, such a pickup frequently does not produce the exact tonal quality of the instrument, yet on the other hand will amplify other sounds, such as those normally inaudible ones produced by jarring or shaking the instrument.

OBJECTS OF THE INVENTION

It is therefore an object of the instant invention to provide an improved sound pickup for a string instrument.

Another object is to provide such a pickup which is equally usable on all types of string instrument, yet which is particularly suited to reproduce the exact sound of the instrument so that, for example, an amplified acoustic guitar does not take on a characteristic electric-guitar sound.

Another object is to provide such a pickup which is relatively insensitive to surrounding sound, that is which only picks up those vibrations that are intentionally created in the strings by the player, whether by plucking a guitar, bowing a violin, depressing a key and thereby hammering on a piano string, or otherwise.

SUMMARY OF THE INVENTION

These objects are attained according to the instant invention by the expedient of applying to the bridge of a string instrument a strain gauge which serves to transduce the sounds transmitted from the string to the instrument through the bridge which are evidenced in the bridge as stresses that are easily and perfectly transduced by the strain gauge into variations in electrical resistance.

With the system according to the instant invention it is therefore possible very accurately to convert the sounds produced by strings of a string instrument into electrical signals with the introduction of virtually no noise into the signal. What is more, such a system is relatively insensitive to external noises, as it merely reacts to stresses in the bridge caused by vibration of the string relative to the sounding board or resonance element of the instrument. Thus a loud sound will subject the entire instrument, that is the string, the bridge, and the sounding element, to some small displacement, which will not, however, be picked up at all by the strain gauge. This feature makes the pickup according to the instant invention eminently suitable for live or concert performances in often extremely noisy environments, much as the so-called throat microphone is used in environs of extremely loud external noise. This selectivity can be even more greatly increased by setting the strain gauges up in a manner well known per se to have a frequency response which is exactly tailored to the frequency of the string or group of strings whose vibration is being detected by the strain gauge.

According to a further feature of this invention the strain gauges, which are almost invariably anisotropic so as to have a direction of sensitivity in which they can measure strain with strains oriented in other directions being ignored, are arranged with their sensitive directions substantially normal to the strings while being located between the strings and the sounding element. Consequently the vibrations of the strings are exactly transduced in the very direction of maximum sensitivity of the strain gauges. This feature once again eliminates the picking up of extraneous sounds or vibrations.

According to another feature of this invention the bridge extends transverse to the strings, and is subdivided by a plurality of slots extending generally parallel to the strings into a plurality of separate sections each of which engages a group of springs comprising the strings for a given chord, two strings of the same note, or even only a single string. Each such section is normally rectangular in shape and has two pairs of opposite parallel side and end faces. The strain gauges may be applied to the end faces, i.e. the faces parallel to the strings, or to the side faces which extend perpendicular to the strings. It is possible to connect a strain gauge on an end face to one amplifier network and a strain gauge on the associated side face to another amplifier network for stereophonic sound reproduction, pulling sounds of different phases out of the same note.

According to another feature of this invention the bridge is formed with a groove extending transversely to all the strings and crossing the above-mentioned slots, so as to subdivide each of the sections into a pair of subsections. In this arrangement the strain gauges for the sections may be potted in a hard synthetic-resin material in this groove between adjacent subsections for excellent sound pickup. Gauges may also be applied to the outer faces of such a bridge.

For a stereo effect it is possible according to this invention to connect the two strain gauges on opposite side faces of a given section to the amplifier for one channel and to connect two strain gauges on the end faces of each section together for use as the other channel. In fact it is possible to use pairs of strain gauges as described above in bridge arrangements so that the output of the transducer remains the same regardless of variations in external factors such as heat, string stress, and the like.

The strain gauges according to this invention may be of the metallic type. It is also within the scope of this invention to use semiconductor strain gauges of the thin-film type which are particularly suitable by virtue of their light weight and small dimensions.

SPECIFIC DESCRIPTION

Figure 1:
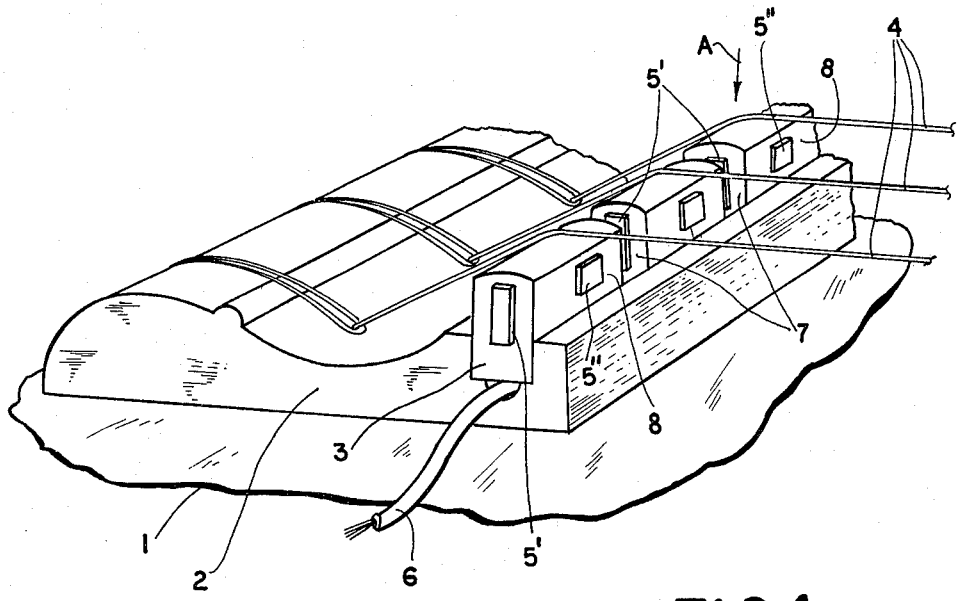
FIG. 1 is a perspective view of an assembly according to the instant invention.
Figure 2:
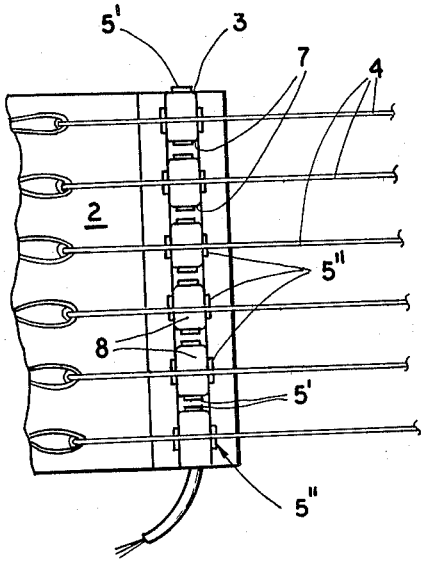
FIG. 2 is a top view of the assembly of FIG. 1.

As shown in FIGS. 1 and 2 the sounding board 1 of a guitar has a string anchor 2 carrying a bridge 3 over which are spanned a plurality of guitar strings 4. This bridge 3 extends perpendicular to the strings 4 and is provided with a plurality of flat strain gauges 5' and 5'', the former extending in respective planes parallel to the strings 4 and the latter in planes perpendicular to the strings 4. A multiconductor lead 6 is connected to these strain gauges 5' and 5''.

The bridge 3 is subdivided by a plurality of slots 7 into a plurality of sections 8 on each of which bears a single string 4, although in other types of string instruments it would be possible for more than one such string 4 to bear on each of the sections 8. The gauges 5' are mounted on the short end faces of these sections 8 and the gauges 5'' on the long side faces.

Figure 7:
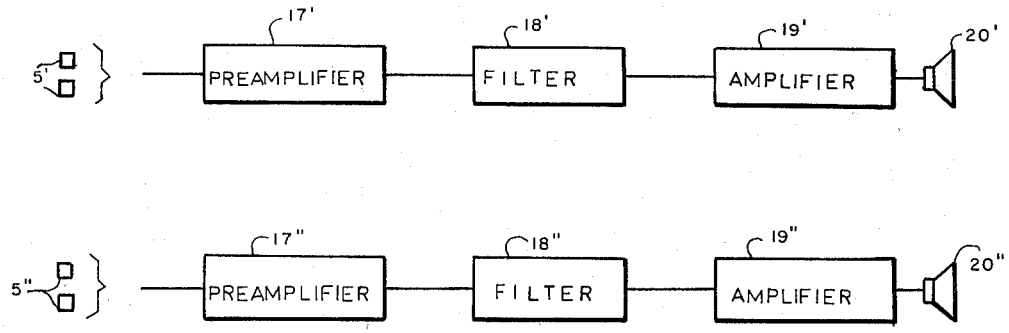

As shown in FIG. 7, the strain gauges 5' are connected to a preamplifier 17' and the strain gauges 5'' to a preamplifier 17'' each in turn connected to a respective filter 18' or 18''. The outputs of these filters are connected to further amplifiers 19' and 19'' whose outputs are connected to respective speakers 20' and 20'' for a stereo effect, since there will be some phase difference between the outputs of these different strain gauges 5' and 5'' for the same section 8.

As mentioned above, the strain gauges 5' and 5'' lie in respective planes either perpendicular or parallel to the strings 4. These gauges 5' and 5'' are anisotropic and have directions A of maximum sensitivity which extend perpendicular to the strings 4 and to the sounding board 1. Thus only vibrational energy effective between the strings 4 and the sounding board 1 will be transduced by the strain gauges 5' and 5''.

Figure 3:
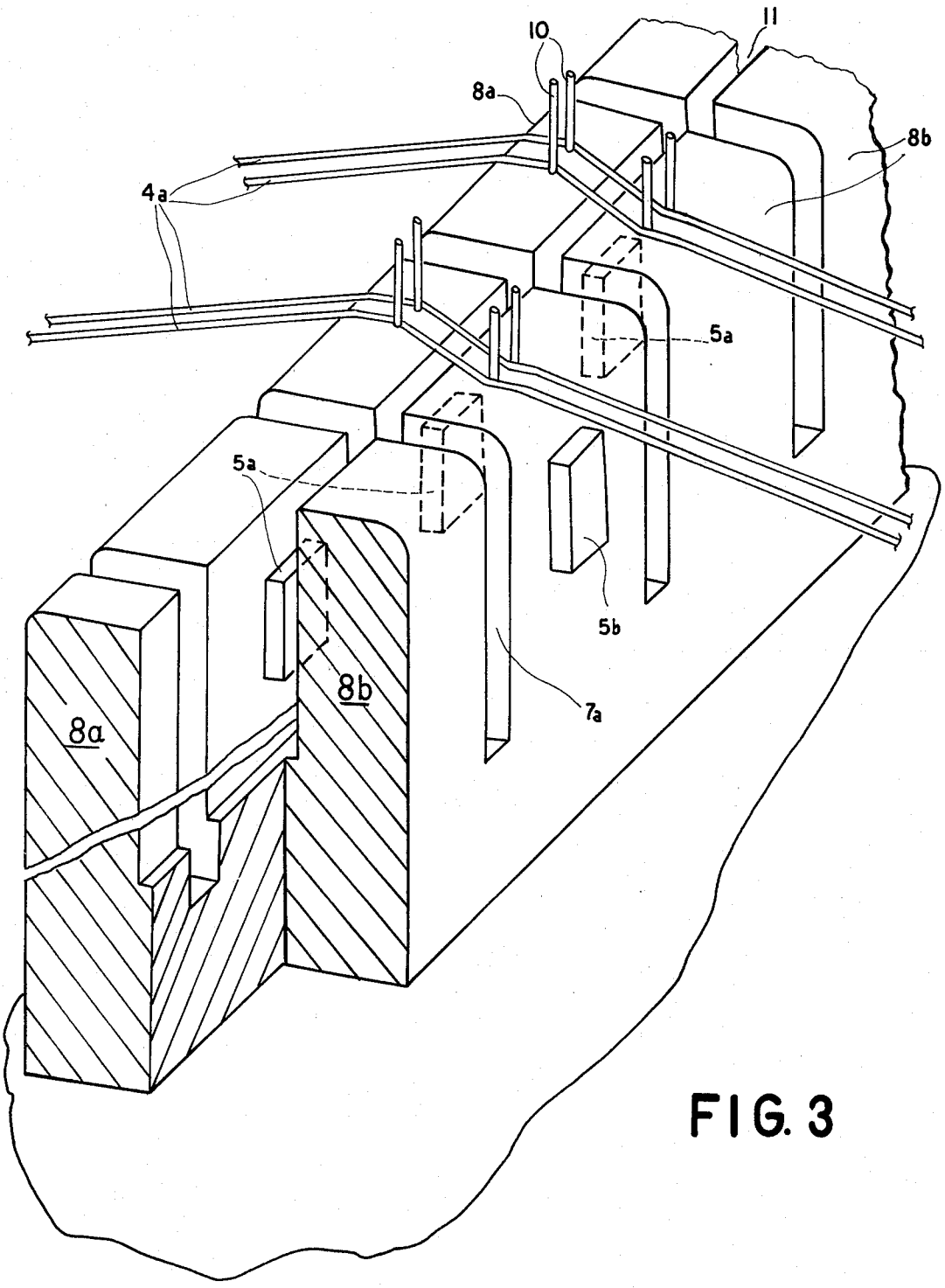
FIGS. 3 and 4 are views similar to FIGS. 1 and 2, respectively, showing another arrangement in accordance with this invention.
Figure 4:
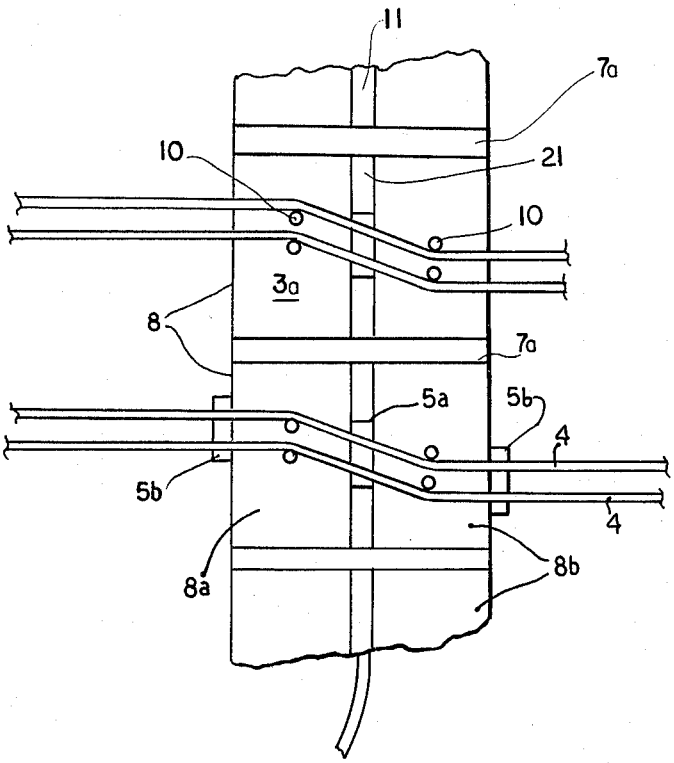

FIGS. 3 and 4 show another arrangement wherein a bridge **3*a* for a piano is divided by transverse slots 7*a* and a longitudinal groove 11 into a plurality of subsections 8*a* and 8*b* on each of which bear the strings 4*a* for a respective note, with the guide pins 10 provided on the subsections 8*a* and 8*b*. Potted in a mass of material 21 (shown only in FIG. 4) in the groove 11 are a plurality of strain gauges 5*a*, one for each pair of subsections 8*a* and 8*b*. It is also within the scope of this invention to mount further strain gauges 5*b* on the outer faces of the subsections and to couple them up for a stereo effect as shown in FIG. 7**.

Figure 6:
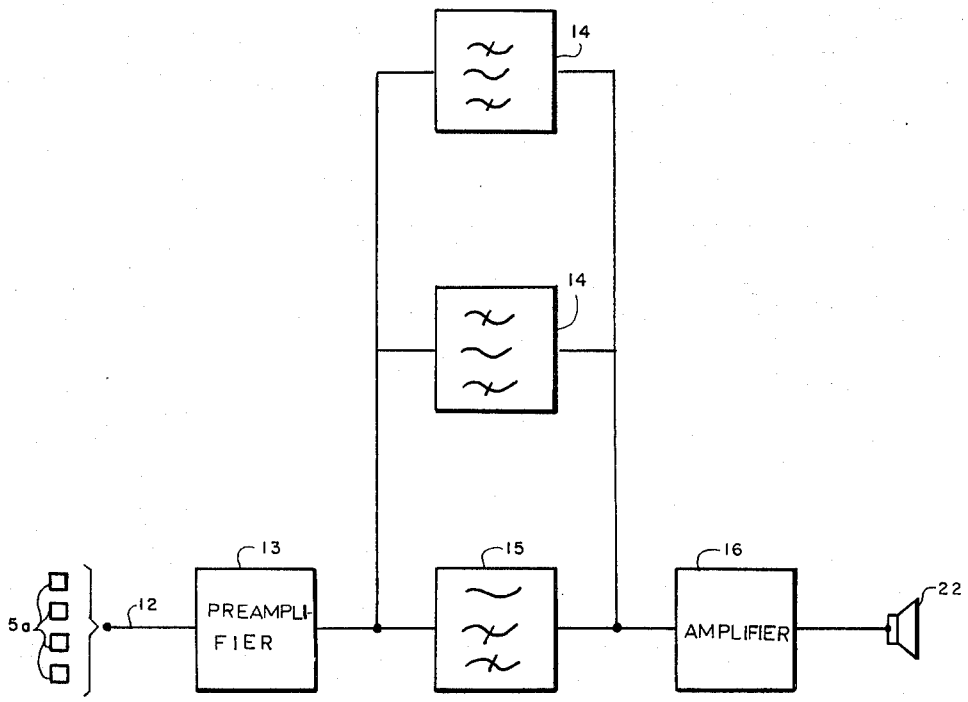
FIGS. 6 and 7 are circuit diagrams of the arrangement in accordance with the instant invention.

The strain gauges **5*a* can be connected up as shown in FIG. 6 to the input 12 of a buffer preamplifier 13 whose output is connected to a pair of band-pass filters 14 and to a high-pass filter 15 in parallel with the filters 14 to an amplifier 16 that in turn feeds an output speaker 22. These filters 14 and 15** are set up to eliminate the pickup of spurious noises.

Figure 5:
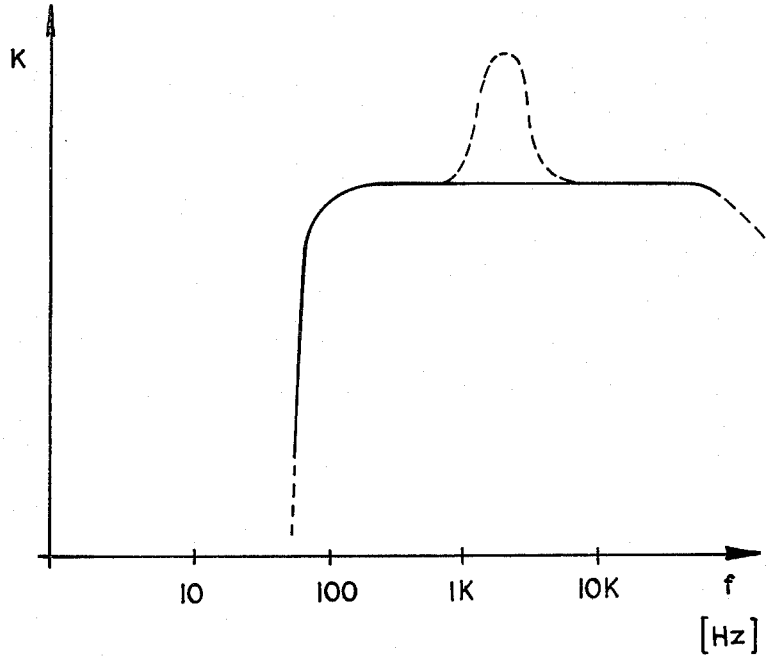
FIG. 5 is a graph showing the frequency response of the pickup according to this invention.

The strain gauges produce an energy output as shown at K in FIG. 5 only for sound within the normally audible spectrum shown on the abscissa of the graph of FIG. 5. Thus between a frequency of approximately 70 Hz and 18 kHz the response of the strain gauges is flat. It is possible to provide increased sensitivity at a central region between 1000 Hz and 5000 Hz, the so-called mid-range of the audible sound spectrum, if desired.

I claim:

1. In a musical instrument having a bridge, a plurality of electrical tone pickups, a sounding element, and a plurality of elongated strings maintained under longitudinal tension and bearing through said bridge on said sounding element, the improvement wherein:

said electrical tone pickups are strain gauges fixed to said bridge, said strings are arranged in groups each having at least one string and at least one such strain gauge is secured to said bridge between each group and said sounding element, said strain gauges each have a predetermined respective direction of maximum sensitivity arranged substantially perpendicular to the respective group of strings, each strain gauge extending between the respective group and said sounding element, said bridge is elongated transversely of said strings and is formed with slots extending generally parallel to said strings and subdividing said bridge into a plurality of sections which each engage a single respective group of said strings and which each have at least one such strain gauge, and said bridge is formed with a groove extending generally perpendicular to said slots and subdividing each of said sections into a pair of subsections.

2. The improvement defined in claim 1 wherein said instrument is a necked string instrument.

3. The improvement defined in claim 1 wherein said instrument is a piano-type string instrument.

4. The improvement defined in claim 1 wherein each such section is provided with a respective such strain gauge.

5. The improvement defined in claim 1 wherein each strain gauge is seated in said slot between the respective subsections, said improvement further comprising a mass of substantially rigid material filling said slot around said gauges between the respective subsections.

6. In a musical instrument having a bridge, a plurality of electrical tone pickups, a sound element, and a plurality of elongated strings maintained under longitudinal tension and bearing through said bridge on said sounding element, the improvement wherein:

said electrical tone pickups are strain gauges fixed to said bridge;

said strings are arranged in groups each having at least one string and at least one such strain gauge is secured to said bridge between each group and said sounding element, said strain gauges each have a predetermined respective direction of maximum sensitivity arranged substantially perpendicular to the respective group of strings, each strain gauge extending between the respective group and said sounding element, said bridge is elongated transversely of said strings and is formed with slots extending generally parallel to said strings and subdividing said bridge into a plurality of sections which each engage a respective group of said strings and which each have a respective such strain gauge, and each of said sections has at least one pair of opposite and generally parallel flat sides extending generally perpendicular to the respective group of strings with each such side carrying one such strain gauge.

7. The improvement defined in claim 6 wherein the gauges of each such side are connected together, said improvement further comprising means for transducing the output of said gauges into audible sound.

8. The improvement defined in claim 7 wherein each section has two such pairs of opposite sides each carrying a respective such strain gauge, said improvement further comprising means for separately transducing the outputs of the different sides of each such section into separate stereophonic sound signals.

* * * * *